US012234836B1

(12) United States Patent
Shoji et al.

(10) Patent No.: US 12,234,836 B1
(45) Date of Patent: Feb. 25, 2025

(54) FAN

(71) Applicant: MINEBEA MITSUMI Inc., Nagano (JP)

(72) Inventors: Hirofumi Shoji, Nagano (JP); Kei Kubota, Nagano (JP)

(73) Assignee: MINEBEA MITSUMI Inc., Nagano (JP)

( * ) Notice: Subject to any disclaimer, the term of this patent is extended or adjusted under 35 U.S.C. 154(b) by 0 days.

(21) Appl. No.: 18/364,729

(22) Filed: Aug. 3, 2023

(51) Int. Cl.
*F04D 25/06* (2006.01)
*F04D 19/00* (2006.01)
*F04D 29/54* (2006.01)

(52) U.S. Cl.
CPC ..... *F04D 29/542* (2013.01); *F04D 19/002* (2013.01); *F04D 25/0606* (2013.01)

(58) Field of Classification Search
CPC ... F04D 29/542; F04D 25/0606; F04D 19/002
See application file for complete search history.

(56) References Cited

U.S. PATENT DOCUMENTS 8,087,887 B2 * 1/2012 Lee ..... F04D 29/545 415/220
8,408,884 B2 4/2013 Hsu et al.
9,028,223 B2 * 5/2015 Kitamura ..... H02K 5/08 417/353
9,957,965 B2 * 5/2018 Yamagata ..... F04D 19/002
2003/0077175 A1 * 4/2003 Marlander ..... F04D 29/281 416/203
2008/0219836 A1 * 9/2008 Decker ..... F04D 29/542 29/889.3
2008/0219849 A1 9/2008 Decker et al.
2011/0129346 A1 6/2011 Jarrah et al.
2013/0209294 A1 8/2013 Iwamoto et al.
(Continued)

FOREIGN PATENT DOCUMENTS

JP S62-147099 7/1987
JP 2003-532026 10/2003
(Continued)

OTHER PUBLICATIONS

International search report for PCT/JP2024/017212 mailed on Jul. 30, 2024.

*Primary Examiner* — David E Sosnowski
*Assistant Examiner* — Theodore C Ribadeneyra
(74) *Attorney, Agent, or Firm* — IPUSA, PLLC

(57) ABSTRACT

A fan according to one embodiment of the present disclosure includes a casing, an impeller including a hub portion, rotor blades, and a cylindrical portion, and fixed blades, the casing including an increasing diameter portion having an inner circumferential surface increasing in inner diameter from an air inlet side toward an air outlet side, a maximum outer diameter of the rotor blades being larger than a minimum inner diameter of the increasing diameter portion, a position of the minimum inner diameter of the increasing diameter portion being located, in an axial direction, at the air inlet side of a position of the maximum outer diameter of the rotor blades, the rotor blades projecting, in the axial direction, from the hub portion toward an air inlet, and a length of the fixed blades in the axial direction being longer than a width of the fixed blades along a radial direction.

17 Claims, 10 Drawing Sheets

(56) References Cited

U.S. PATENT DOCUMENTS

| | | | | |
|---|---|---|---|---|
| 2015/0354578 | A1* | 12/2015 | Avedon | F04D 29/544 415/222 |
| 2018/0087527 | A1 | 3/2018 | Dossner et al. | |
| 2020/0116159 | A1 | 4/2020 | Yang et al. | |
| 2020/0333027 | A1* | 10/2020 | Avedon | F24F 7/007 |
| 2021/0010484 | A1 | 1/2021 | Ohno et al. | |

FOREIGN PATENT DOCUMENTS

| | | |
|---|---|---|
| JP | 5945912 | 7/2016 |
| JP | 2021-011867 | 2/2021 |
| JP | 2021-195943 | 12/2021 |
| JP | 2022-035066 | 3/2022 |

* cited by examiner

FAN

BACKGROUND OF INVENTION

1. Technical Field

The present disclosure relates to fans.

2. Background Art

Axial flow fans described in Patent Documents 1 to 3 each include: an impeller having rotor blades; and a casing housing the impeller. The casing is provided with an air inlet and an air outlet. Along with rotation of the impeller, air from the air inlet passes through a flow path inside of the casing, and is discharged from the air outlet. Regarding the flow path inside of the casing, the inner diameter thereof at a farther position from the air inlet is larger than the inner diameter thereof at a closer position to the air inlet. Regarding the impeller disposed inside of the casing, the outer diameter of the outer circumferential edge of the rotor blade thereof at a farther position from the air inlet is larger than the outer diameter of the outer circumferential edge of the rotor blade thereof at a closer position to the air inlet.

CITATION LIST

Patent Literature

[Patent Document 1] Japanese Laid-Open Patent Publication No. 2022-35066

[Patent Document 2] Japanese Laid-Open Patent Publication No. 2021-11867

[Patent Document 3] Japanese Patent No. 5945912

SUMMARY OF INVENTION

A fan according to one embodiment of the present disclosure includes:

- a casing that includes an air inlet and an air outlet, and in which a flow path communicating from the air inlet to the air outlet is formed;
- an impeller that is disposed in the casing and rotatable about an axis, the impeller including
  - a hub portion disposed at an air inlet side,
  - a plurality of rotor blades formed on the hub portion, and
    - a cylindrical portion that extends from the hub portion to an air outlet side, and forms a flow path between the cylindrical portion and the casing; and
- a plurality of fixed blades that extend, in a radial direction, from an inner circumferential surface of the casing toward an outer circumferential surface of the cylindrical portion of the impeller, in which
- the casing includes an increasing diameter portion having the inner circumferential surface that increases in inner diameter from the air inlet side toward the air outlet side,
- a maximum outer diameter of the plurality of rotor blades is larger than a minimum inner diameter of the increasing diameter portion,
- a position of the minimum inner diameter of the increasing diameter portion is located, in an axial direction, at the air inlet side of a position of the maximum outer diameter of the plurality of rotor blades,

- the plurality of rotor blades project, in the axial direction, from the hub portion toward the air inlet, and
- a length of the plurality of fixed blades in the axial direction is longer than a width of the plurality of fixed blades along the radial direction.

The present disclosure can provide a fan that can ensure airflow volume and suppress an increase in noise.

DESCRIPTION OF EMBODIMENTS

Figure 1:
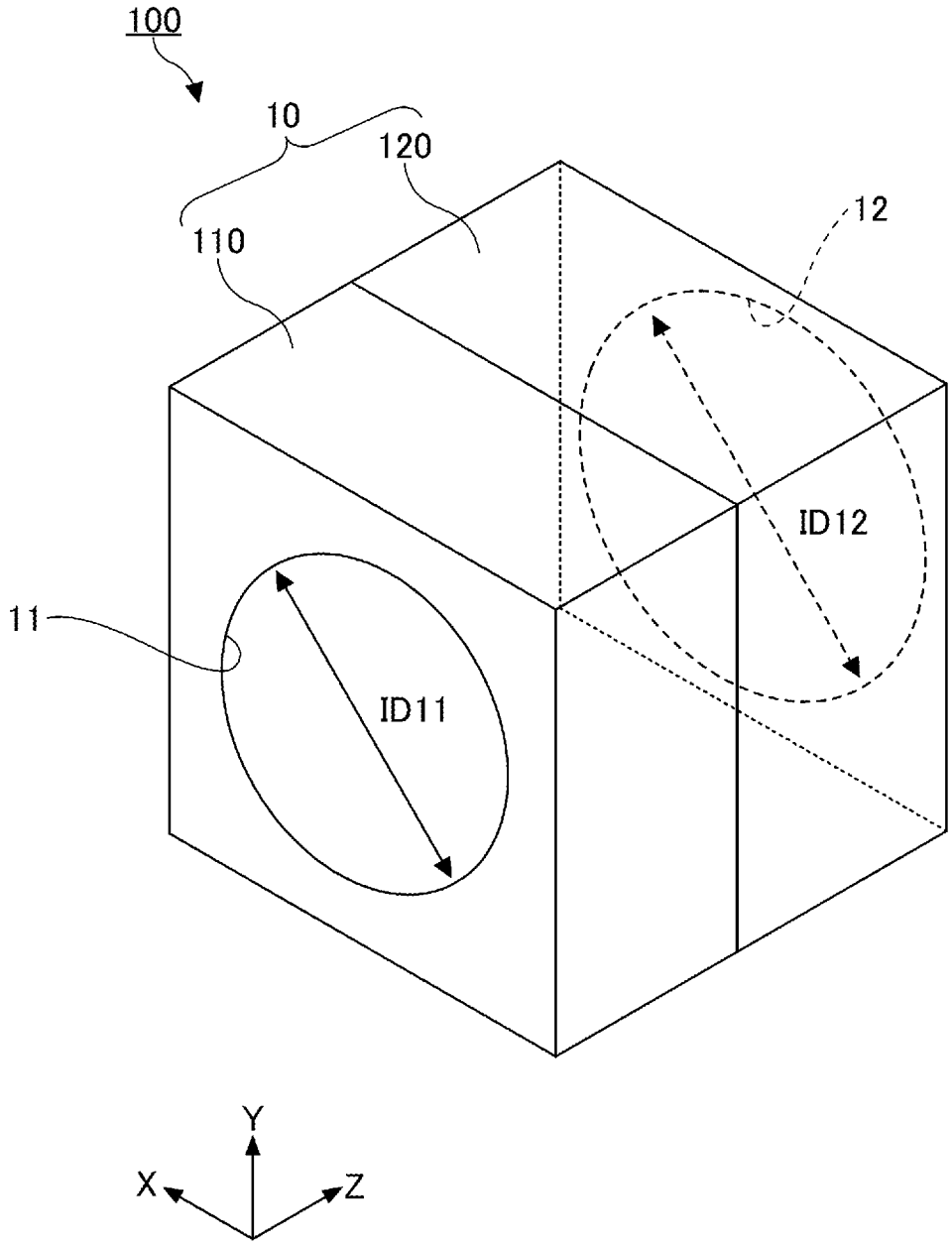
FIG. 1 is a perspective view of a casing of a fan according to an embodiment.

Referring to the attached drawings, non-limiting examples of the present invention will be described. Note that, in the attached drawings, the same or corresponding members or parts are given the same or corresponding reference numerals. Also, in the following, duplicate description of the same or corresponding members or parts will be omitted. Further, in the drawings, the members or parts are not necessarily drawn to scale. Therefore, those skilled in the art can determine specific dimensions in any way with reference to the following non-limiting examples. Also, the following examples do not limit but exemplifies the invention. Further, features described in the examples or combination thereof are not necessarily essential to the invention.

[Fan According to Embodiment]

Figure 2:
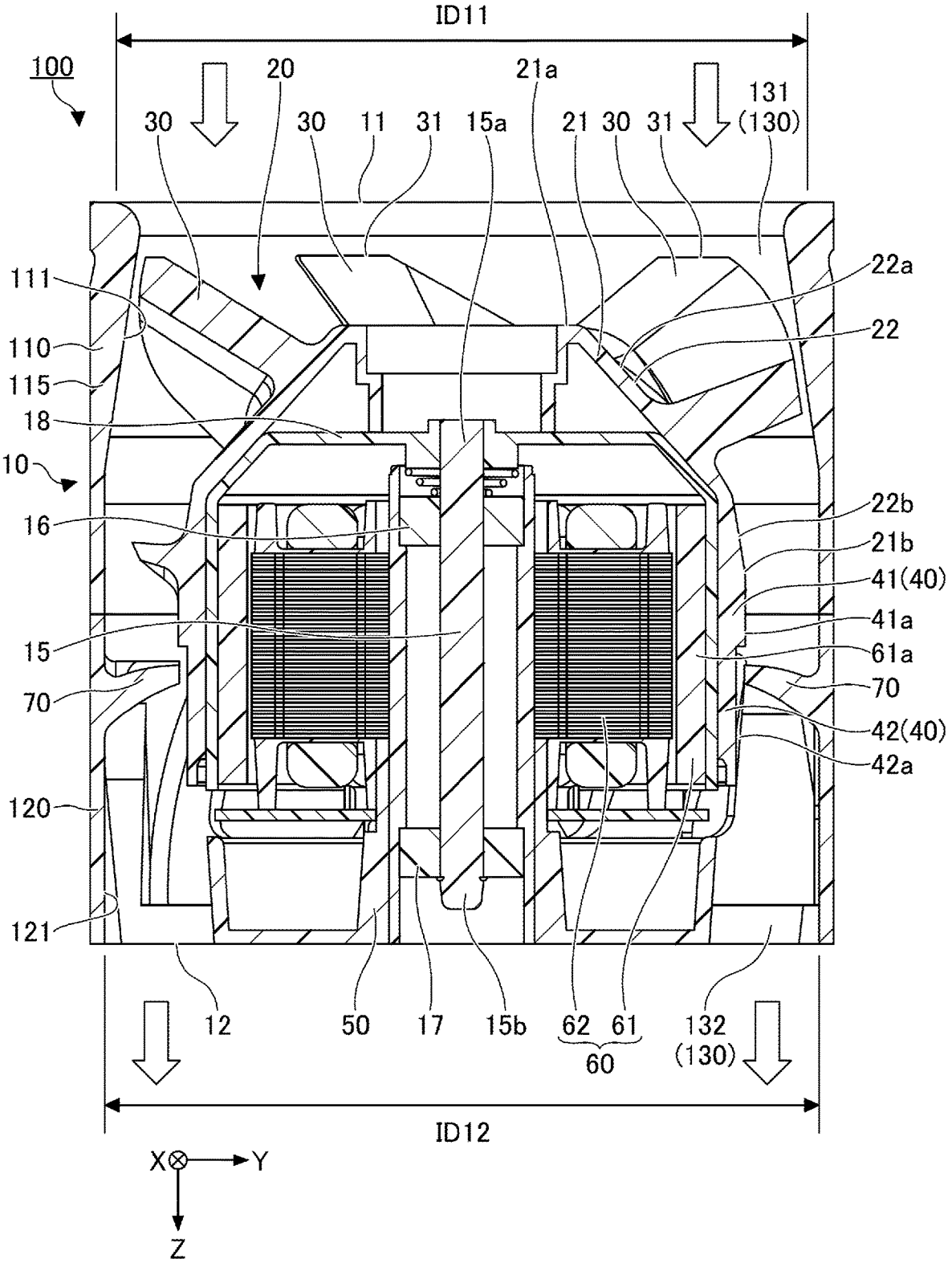
FIG. 2 is a cross-sectional view along an axial direction of the fan according to the embodiment.
Figure 3:
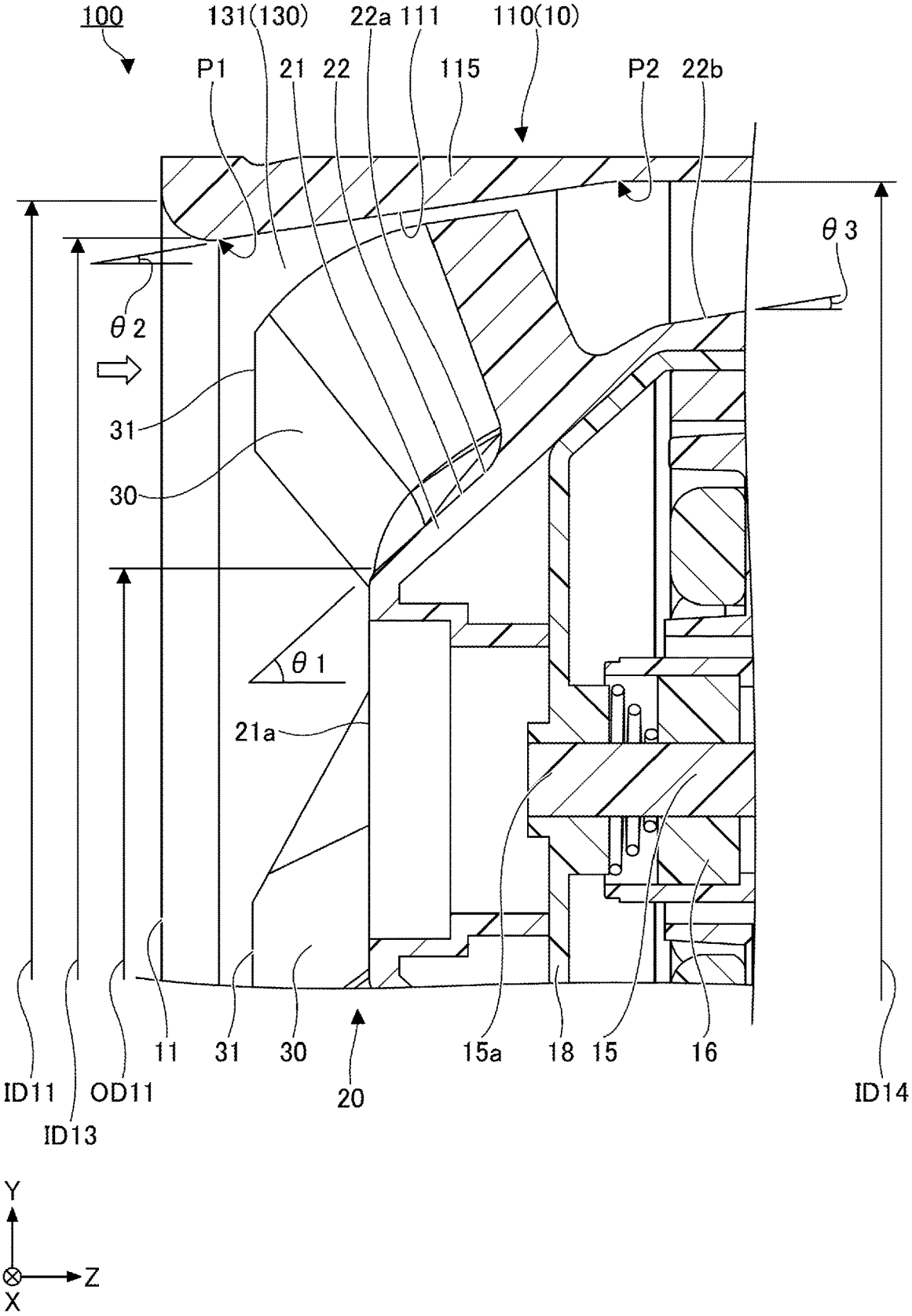
FIG. 3 is a cross-sectional view illustrating a first casing and an impeller that are enlarged.

FIG. 1 is a perspective view of a casing 10 of a fan 100 according to an embodiment. FIG. 2 is a cross-sectional view along an axial direction of the fan 100 according to the embodiment. FIG. 3 is a cross-sectional view illustrating a first casing 110 and an impeller 20 that are enlarged. In the drawings, an X-axis direction, a Y-axis direction, and a Z-axis direction that are orthogonal to each other may be illustrated. The Z-axis direction is a direction in which a shaft 15 extends. The X-axis direction and the Y-axis direction are along a radial direction. The shaft 15 is one example of an axis. When the description "axial direction" is simply used, it is the direction in which the shaft 15 extends. Also, when the description "radial direction" is simply used, it is a radial direction of the shaft 15 and is a direction that is orthogonal to the axial direction.

Also, in the present specification, the terms "upper" and "lower" may be used. An upper-lower direction in this case is the direction in which the shaft 15 extends, and a region that is closer to an air inlet 11 is referred to as "upper" and a region that is closer to an air outlet 12 is referred to as "lower". Note that, the actual arrangement in the fan 100 may or may not follow this. The shaft 15 may be disposed along the upper-lower direction, or may be disposed along the horizontal direction.

Also, in the present specification, the terms "air inlet side" and "air outlet side" may be used. The "air inlet side" is a region that is closer to the air inlet. The air outlet side" is a region that is closer to the air outlet.

The fan 100 as illustrated in FIG. 1 to FIG. 3 is, for example, a fan that is usable for cooling of electronic devices such as a server. The fan 100 is attached to a casing of an electronic device and feeds air into the casing, and can cool the electronic device inside of the casing. Applications of the fan 100 are not limited to the cooling of the electronic devices, but the fan 100 is usable for other applications. The fan 100 can feed air. The fan 100 may feed gas other than the air.

As illustrated in FIG. 2, the fan 100 includes the casing 10, the shaft 15, the impeller 20, a base 50, and a motor 60. The fan 100 includes a plurality of rotor blades 30 formed in the impeller 20, and a fixed blade 70 formed in an inner circumferential surface of the casing 10. The impeller 20 includes a hub portion 21, the plurality of rotor blades 30, and a cylindrical portion 40.

[Casing]

As illustrated in FIG. 1 and FIG. 2, the air inlet 11 and the air outlet 12 are formed in the casing 10. The casing 10 includes the first casing 110 and a second casing 120. The first casing 110 and the second casing 120 are connected to each other in the Z-axis direction. The air inlet 11 is formed in the first casing 110, and the air outlet 12 is formed in the second casing 120. The air inlet 11 and the air outlet 12 face each other in the Z-axis direction.

The casing 10 may be formed in a cuboid. The casing 10 may be formed in a cube. The casing 10 may be formed in a cylindrical shape, or may be formed in another shape. The casing 10 may be provided with a flange or a bracket.

As illustrated in FIG. 2, a flow path 130 from the air inlet 11 toward the air outlet 12 is formed inside of the casing 10. The flow path 130 includes a flow path 131 and a flow path 132 that are in communication with each other in the Z-axis direction. The flow path 131 is in communication with the air inlet 11, and the flow path 132 is in communication with the air outlet 12. The flow path 132 is a flow path downstream of the flow path 131. Note that, in the Z-axis direction, a region that is closer to the air inlet 11 is referred to as "upstream", and a region that is closer to the air outlet 12 is referred to as "downstream". Also, description may be made with, in the Z-axis direction, the region closer to the air inlet 11 being referred to as "front" and the region closer to the air outlet 12 being referred to as "back".

[First Casing]

The air inlet 11 is formed in the first casing 110. The flow path 131 is formed inside of the first casing 110. The first casing 110 is provided with an opening that is continuous in the Z-axis direction. An inner circumferential surface 111 of the first casing 110 is formed in a circular shape as viewed in the Z-axis direction. The first casing 110 houses the impeller 20. The first casing 110 houses a portion of the shaft 15 that is closer to the air inlet 11, a portion of the cylindrical portion 40 that is closer to the air inlet 11, and a portion of the motor 60 that is closer to the air inlet 11.

[Second Casing]

The air outlet 12 is formed in the second casing 120. The flow path 132 is formed inside of the second casing 120. The second casing 120 is provided with an opening that is continuous in the Z-axis direction. An inner circumferential surface 121 of the second casing 120 is formed in a circular shape as viewed in the Z-axis direction. The second casing 120 houses the base 50. The second casing 120 houses a portion of the shaft 15 that is closer to the air outlet 12, a portion of the cylindrical portion 40 that is closer to the air outlet 12, and a portion of the motor 60 that is closer to the air outlet 12.

[Air Inlet and Air Outlet]

The air inlet 11 and the air outlet 12 are formed at such positions as to face each other in the Z-axis direction. An inner diameter ID11 of the air inlet 11 is, for example, smaller than an inner diameter ID12 of the air outlet 12. The air inlet 11 may be an end portion existing the most upstream of the flow path 130. The air outlet 12 may be an end portion existing the most downstream of the flow path 130. The inner diameter ID11 of the air inlet 11 may be larger than the inner diameter ID12 of the air outlet 12, or may be the same as the inner diameter ID12 of the air outlet 12. In the flow path 130, a portion having an inner diameter smaller than the inner diameter ID11 is formed downstream of the air inlet 11.

[Inner Circumferential Surface of the First Casing]

The first casing 110 includes an increasing diameter portion 115. The increasing diameter portion 115 includes a portion of the inner circumferential surface 111 that is formed so that the distance from the center in the radial direction becomes longer. The center in the radial direction is the position of the shaft 15. The center in the radial direction may be a position on an extension of the shaft 15.

The inner diameter of the increasing diameter portion 115 is larger at a position farther from the air inlet 11 than at a position closer to the air inlet 11. As illustrated in FIG. 3, the increasing diameter portion 115 is formed from a position P1 to a position P2 in the Z-axis direction. An inner diameter ID13 of an inner circumferential surface of the increasing diameter portion 115 at the position P1 is smaller than an inner diameter ID14 of an inner circumferential surface 111 of the increasing diameter portion 115 at the position P2.

The inner diameter ID13 of the inner circumferential surface 111 of the increasing diameter portion 115 at the position P1 is the minimum inner diameter of the inner diameter of the inner circumferential surface 111 of the increasing diameter portion 115. The inner diameter ID14 of the inner circumferential surface 111 of the increasing diameter portion 115 at the position P2 is the maximum inner diameter of the inner diameter of the inner circumferential surface 111 of the increasing diameter portion 115. The inner diameter ID13 of the inner circumferential surface of the increasing diameter portion 115 at the position P1 is smaller than the inner diameter ID11 of the air inlet 11. The inner diameter ID14 of the inner circumferential surface 111 of the increasing diameter portion 115 at the position P2 is the same as the inner diameter ID12 of the air outlet 12. "The same" includes approximately the same.

[Shaft]

Figure 4:
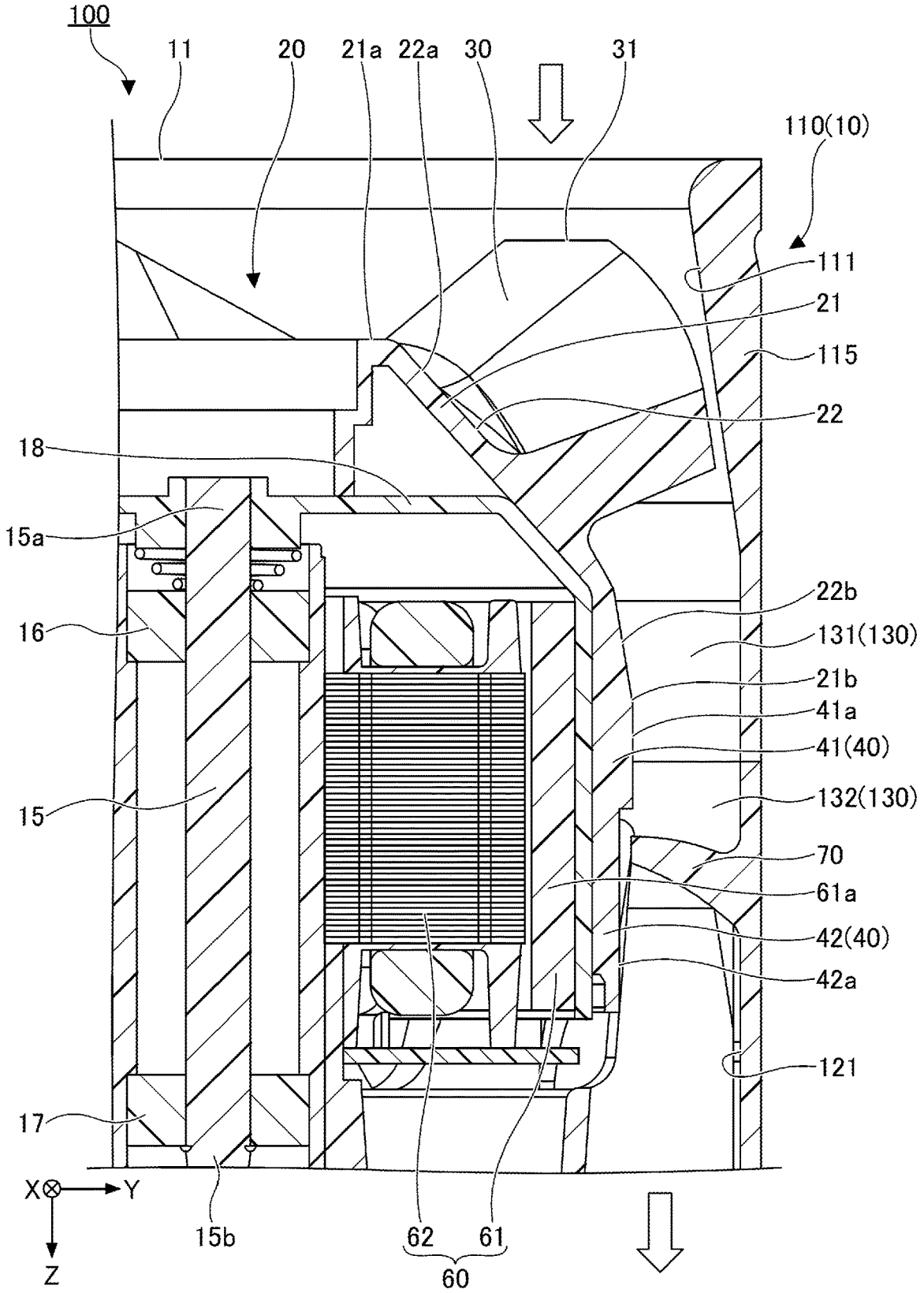
FIG. 4 is a cross-sectional view illustrating the fan that is partially enlarged.

FIG. 4 is a cross-sectional view illustrating the fan 100 that is partially enlarged. As illustrated in FIG. 2 and FIG. 4, the shaft 15 extends in the Z-axis direction. The shaft 15 is a rotation shaft of the motor 60. The shaft 15 is rotatably supported in the casing 10. The shaft 15 includes an end portion 15*a* and an end portion 15*b*. The end portions 15*a* and 15*b* are end portions of the shaft 15 in the longitudinal direction. The end portion 15*a* is disposed to be closer to the air inlet 11, and the end portion 15*b* is disposed to be closer to the air outlet 12.

[Bearing]

The fan 100 includes a pair of bearings 16 and 17 that rotatably support the shaft 15. The bearings 16 and 17 are disposed apart from each other in the Z-axis direction. The bearing 16 is disposed to be closer to the air inlet 11, and the bearing 17 is disposed to be closer to the air outlet 12.

[Impeller]

Figure 5:
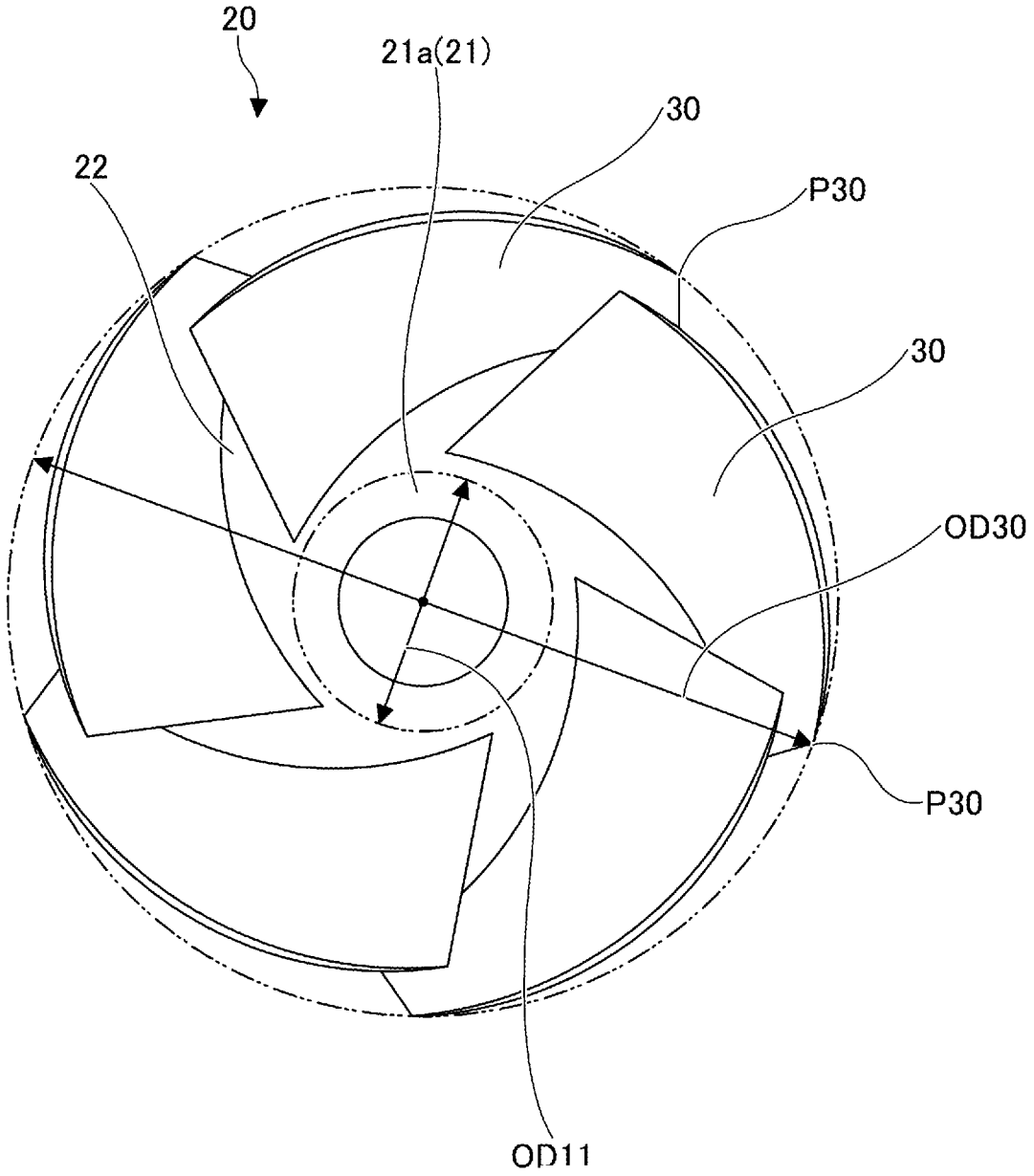
FIG. 5 is a front view of an impeller.
Figure 6:
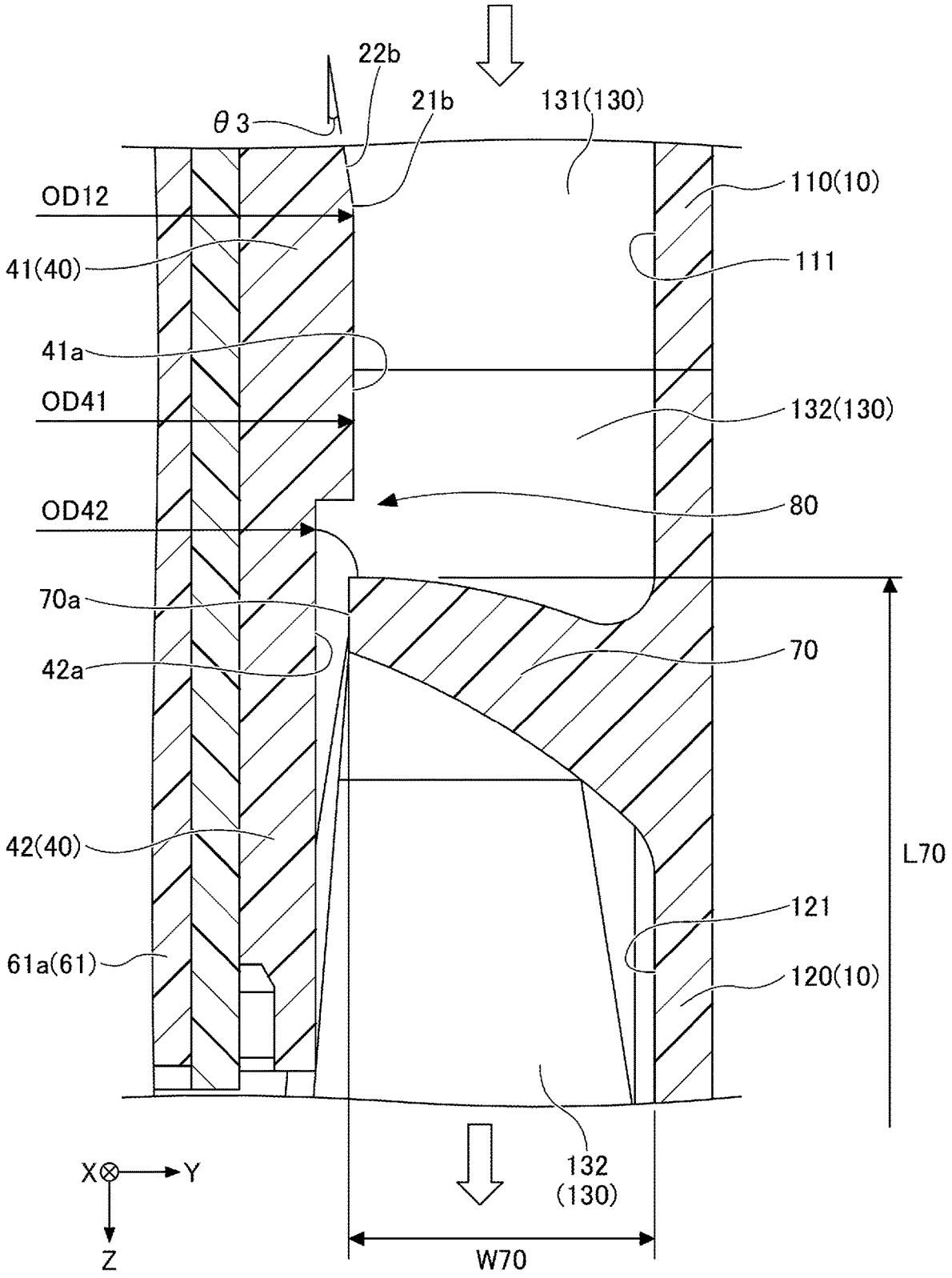
FIG. 6 is a cross-sectional view illustrating a flow path between a cylindrical portion and a casing, with the flow path being enlarged.
Figure 7:
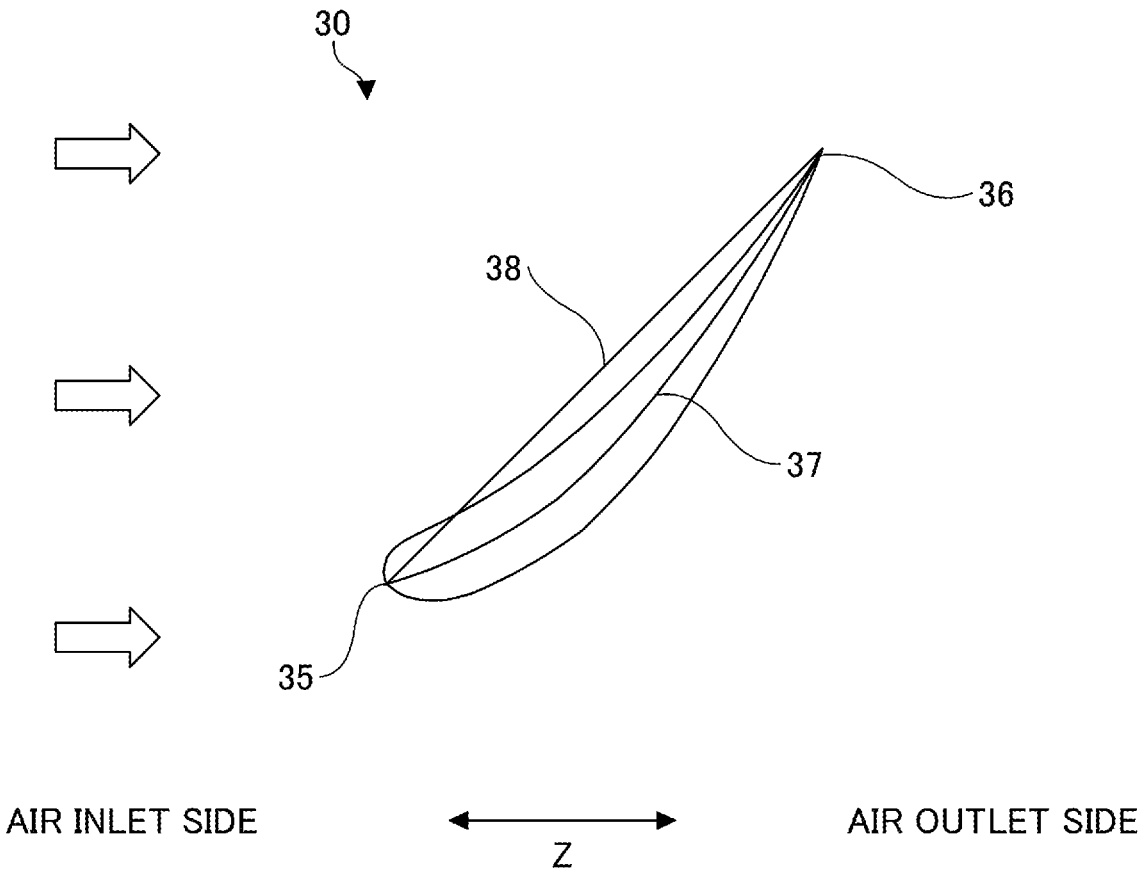
FIG. 7 is a cross-sectional view of a rotor blade.
Figure 8:
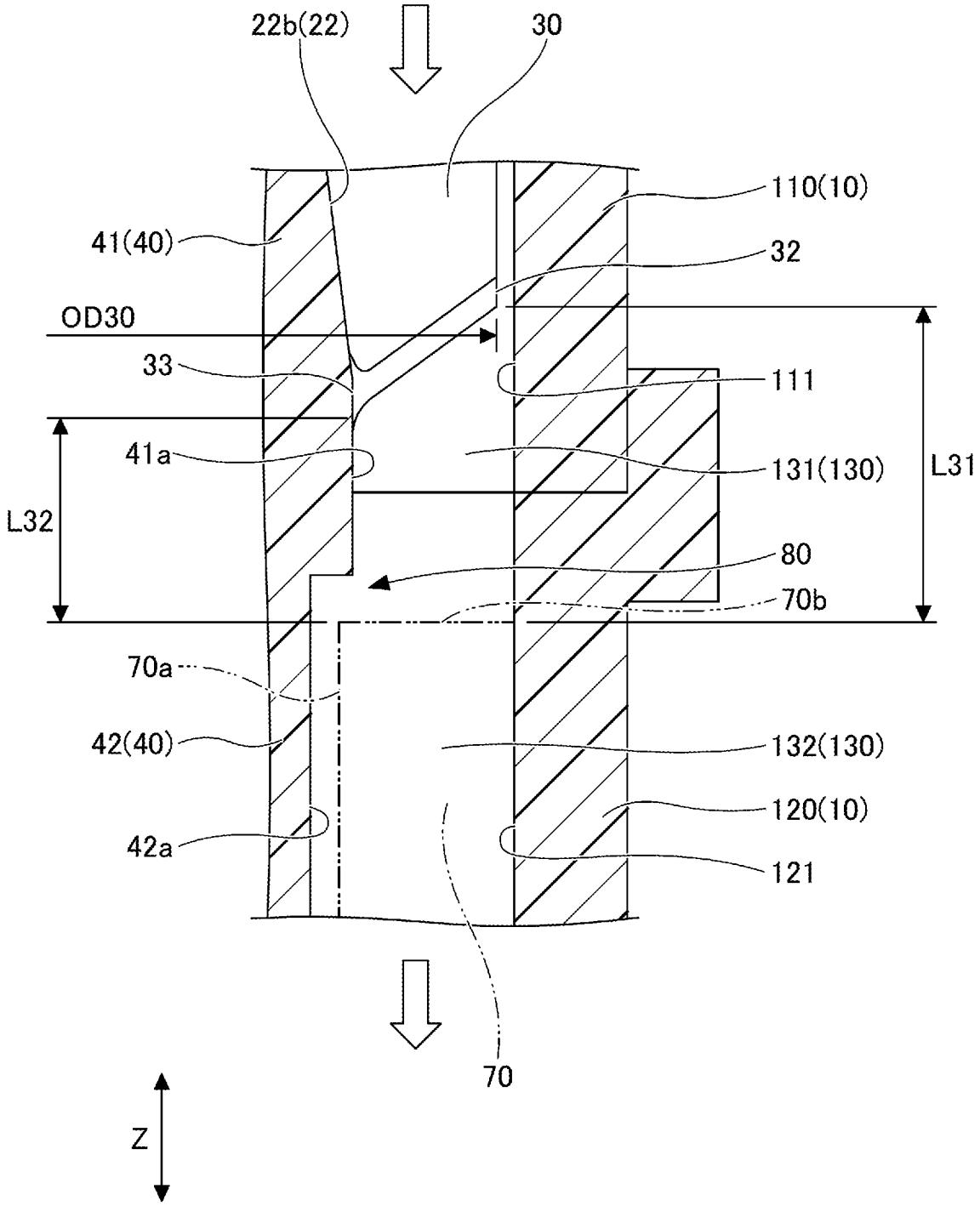
FIG. 8 is a cross-sectional view illustrating the flow path between the cylindrical portion and the casing, with the flow path being enlarged, and is a view illustrating a positional relationship between the rotor blade and the fixed blade.

FIG. 5 is a front view of the impeller 20. FIG. 6 is a cross-sectional view illustrating the flow path 130 between the cylindrical portion 40 and the casing 10, with the flow path 130 being enlarged. FIG. 7 is a cross-sectional view of a rotor blade 30. FIG. 8 is a cross-sectional view illustrating the flow path 130 between the cylindrical portion 40 and the casing 10, with the flow path 130 being enlarged, and is a view illustrating a positional relationship between the rotor blade 30 and the fixed blade 70.

As illustrated in FIG. 2 to FIG. 4, the impeller 20 includes, as described above, the hub portion 21, the plurality of rotor blades 30, and the cylindrical portion 40. In a cross-sectional surface along the Z-axis direction, an outer circumferential surface 22 of the hub portion 21 includes a tilt surface that tilts with respect to the Z-axis direction. An outer diameter of the outer circumferential surface 22 at an upstream side of the impeller 20 is smaller than an outer diameter of the outer circumferential surface 22 at a downstream side of the impeller 20. In other words, the outer diameter of the outer circumferential surface 22 at the downstream side is larger than the outer diameter of the outer circumferential surface 22 at the upstream side. Note that, in the Z-axis direction, the upstream side is a region that is closer to the air inlet 11, and the downstream side is a region that is closer to the air outlet 12.

In the radial direction of the impeller 20, a gap is formed between the outer circumferential surface 22 of the hub portion 21 and the inner circumferential surface 111 of the first casing 110. A gap between the outer circumferential surface 22 of the impeller 20 and the inner circumferential surface 111 of the first casing 110 is the flow path 131.

[Hub Portion]

The outer circumferential surface 22 of the hub portion 21 becomes larger in the outer diameter from upstream toward downstream in the Z-axis direction. As illustrated in FIG. 3, an outer diameter OD11 of the outer circumferential surface 22 of the hub portion 21 that is closer to the air inlet 11 is smaller than an outer diameter OD12 of the outer circumferential surface 22 of the hub portion 21 that is farther from the air inlet 11. The outer diameter OD12 is illustrated in FIG. 6. The outer diameter OD11 of the hub portion 21 may be an outer diameter at a position that is the closest to the air inlet 11 in the Z-axis direction. The outer diameter OD11 of the hub portion 21 may be the minimum outer diameter of the hub portion 21.

The outer diameter OD11 may be, for example, an outer diameter in an end 21*a* of the hub portion 21. The end 21*a* of the hub portion 21 is a position that is the closest to the air inlet 11 in the Z-axis direction. The end 21*a* of the hub portion 21 is disposed at a position away from the air inlet 11 in the Z-axis direction. In the Z-axis direction, the position of the outer diameter OD11 is disposed, for example, between the position P1 and the position P2. The end 21*a* of the hub portion 21 is disposed inside of the increasing diameter portion 115 of the first casing 110 in the Z-axis direction.

The outer diameter OD12 as illustrated in FIG. 6 may be, for example, an outer diameter at a back end 21*b* of the hub portion 21. The back end 21*b* of the hub portion 21 is a position that is the farthest from the air inlet 11 in the Z-axis direction. The back end 21*b* of the hub portion 21 is disposed at a position that is farther from the air inlet 11 than the position P2 in the Z-axis direction. The back end 21*b* of the hub portion 21 may be disposed outside of the increasing diameter portion 115 of the first casing 110 in the Z-axis direction. The back end 21*b* of the hub portion 21 may be disposed downstream of the increasing diameter portion 115 or inside of the increasing diameter portion 115, in the Z-axis direction. The back end 21*b* of the hub portion 21 may be disposed at the same position as the position P2 in the Z-axis direction.

As illustrated in FIG. 2 to FIG. 4, in the radial direction, an interval between the outer circumferential surface 22 of the hub portion 21 and the inner circumferential surface 111 of the first casing 110 is narrower in the downstream side than in the upstream side. The outer circumferential surface 22 is formed so as to become closer to the inner circumferential surface 111 of the first casing 110 in the radial direction.

In the radial direction, a width of the flow path 131 is smaller in the downstream side than in the upstream side. In the radial direction, the width of the flow path 131 becomes narrower from upstream toward downstream. In the radial direction, the width of the flow path 131 is larger in the upstream side than in the downstream side. The impeller 20 is directly or indirectly attached to an end portion 15*a* of the shaft 15.

In the cross-sectional surface along the Z-axis direction, a tilt angle θ1 of the outer circumferential surface 22 of the hub portion 21 with respect to the Z axis is, for example, greater than a tilt angle θ2 of the inner circumferential surface of the increasing diameter portion 115 with respect to the Z axis.

In the cross-sectional surface along the Z-axis direction, the hub portion 21 includes two tilt surfaces having different tilt angles. The outer circumferential surface 22 of the hub portion 21 includes, as the two tilt surfaces, a first tilt surface 22*a* and a second tilt surface 22*b*. Note that, the above tilt angle θ1 is a tilt angle of the first tilt surface 22*a* with respect to the Z axis. A tilt angle θ3 of the second tilt surface 22*a* with respect to the Z axis is smaller than the tilt angle of the first tilt surface 22*a*. The second tilt surface 22*a* is positioned outside in the radial direction of a magnet 61*a* of a rotator 61. The second tilt surface 22*a* is positioned at a position that overlaps the magnet 61*a* of the rotator 61 in the axial direction. The magnet 61*a* is also called a "rotor magnet".

In the fan 100, in which the tilt angle θ3 of the second tilt surface 22*b* with respect to the Z axis is smaller than the tilt angle θ1 of the first tilt surface 22*a* with respect to the Z axis, an attempt is made to improve PQ characteristics (static pressure-airflow volume characteristics).

[Yoke]

The fan 100 includes a yoke 18. The shaft 15 is fixed to the yoke 18. The impeller 20 is fixed via the yoke 18 to the end portion 15*a* of the shaft 15.

[Rotor blade]

As illustrated in FIG. 3 to FIG. 5, the plurality of rotor blades 30 project outside in the radial direction from the outer circumferential surface 22 of the hub portion 21. The plurality of rotor blades 30 are formed on the hub portion 21. Being formed on the hub portion 21 includes being formed relative to the hub portion 21.

The maximum outer diameter OD30 of the plurality of rotor blades 30 is larger than the minimum inner diameter ID13 of the increasing diameter portion 115. In other words, the minimum inner diameter ID13 of the increasing diameter portion 115 is smaller than the maximum outer diameter OD30 of the plurality of rotor blades 30. The minimum inner diameter ID13 of the increasing diameter portion 115 is, for example, an inner diameter at the position P1. As viewed in the Z-axis direction, the inner circumferential surface 111 of the increasing diameter portion 115 at the position P1 is disposed, in the radial direction, inside of the position P30 of the maximum outer diameter OD of the rotor blade 30. The position P30 of the maximum outer diameter OD30 of the rotor blade 30 is a position that is the farthest from the shaft 15 in the radial direction. Note that, the maximum outer diameter OD30 of the rotor blade 30 is illustrated in FIG. 5 and FIG. 8.

The position P1 of the minimum inner diameter ID13 of the increasing diameter portion 115 is, in the Z-axis direction, closer to the air inlet 11 than the position P30 of the maximum outer diameter OD30 of the rotor blade 30 of the impeller 20. In other words, the position P30 of the maximum outer diameter OD of the rotor blade 30 is disposed, in the Z-axis direction, downstream of the position P1 of the minimum inner diameter ID13 of the increasing diameter portion 115. The maximum outer diameter OD30 of the rotor blade 30 is smaller than the inner diameter ID14 at the position P2 of the increasing diameter portion 115.

The plurality of rotor blades 30 project, in the Z-axis direction, toward the air inlet 11 beyond the hub portion 21. The plurality of rotor blades 30 project, in the Z-axis direction, upstream of the end portion 21*a* of the hub portion 21. The end portion 31 in the Z-axis direction of the plurality of rotor blades 30 is disposed, in the Z-axis direction, downstream of the position P1 of the minimum inner diameter ID13 of the increasing diameter portion 115. The end portion 31 of the rotor blade 30 is disposed, in the Z-axis direction, inside of the increasing diameter portion 115. The outer diameter of the end portion 31 of the plurality of rotor blades 30 is smaller than the maximum outer diameter OD30.

[Cylindrical Portion]

As illustrated in FIG. 2, FIG. 4, and FIG. 6, the cylindrical portion 40 is formed so as to be continuous with the back end 21*b* of the hub portion 21 of the impeller 20. An outer circumferential surface of the cylindrical portion 40 is formed so as to be continuous with the outer circumferential surface of the back end 21*b* of the hub portion 21. The cylindrical portion 40 is disposed, in the Z-axis direction, at a position that is closer to the air outlet 12 than the hub portion 21. The cylindrical portion 40 includes a portion 41 and a portion 42. The portion 41 is one example of a first portion of the cylindrical portion 40. The portion 42 is one example of a second portion of the cylindrical portion 40. The cylindrical portion 40 extends from the hub portion 21 to the air outlet 12 side. The cylindrical portion 40 forms the flow path 130 between the cylindrical portion 40 and the casing 10.

The portion 41 and the portion 42 are connected to each other in the Z-axis direction. The portion 41 and the portion 42 are integrally formed. The shaft 15 and the motor 60 are disposed inside of the cylindrical portion 40 in the radial direction. The portion 41 is disposed, in the Z-axis direction, at a position that is closer to the plurality of rotor blades 30 than the portion 42. The portion 42 is disposed, in the Z-axis direction, at a position that is farther from the plurality of rotor blades 30 than the portion 41.

As illustrated in FIG. 4 and FIG. 6, the flow path 130 is formed, in the radial direction, between the outer circumferential surface of the cylindrical portion 40 and the inner circumferential surfaces 111 and 121 of the casing 10. The portion 41 is disposed inside of the first casing 110. A portion, at the downstream side, of the portion 41 may be disposed inside of the second casing 120. The portion 42 is disposed inside of the second casing 120.

The flow path 131, at the upstream side, of the flow path 130 includes a flow path between the outer circumferential surface of the portion 41 of the cylindrical portion 40 and the inner circumferential surface 111 of the first casing 110. The flow path 132, at the downstream side, of the flow path 130 includes a flow path between the outer circumferential surface of the portion 41 and the inner circumferential surface 121 of the second casing 120. The flow path 132 at the downstream side includes a flow path between the outer circumferential surface of the portion 42 and the inner circumferential surface 121 of the second casing 120. As described above, the flow path 131 is a flow path inside of the first casing 110, and the flow path 132 is a flow path inside of the second casing 120.

As illustrated in FIG. 6, an outer diameter OD41 of the outer circumferential surface of the portion 41 is different in length from an outer diameter OD42 of the outer circumferential surface of the portion 42. The outer diameter OD42 of the portion 42 is shorter than the outer diameter OD41 of the portion 41. The outer circumferential surface of the cylindrical portion 40 is provided with a step 80. The step 80 is formed between the outer circumferential surface of the portion 41 and the outer circumferential surface of the portion 42. A positional relationship between the step 80 and the fixed blade 70 will be described below.

[Base]

The base 50 as illustrated in FIG. 2 is disposed inside of the second casing 120. The base 50 is disposed, in the Z-axis direction, at a position that is closer to the air outlet 12. A portion of the base 50 may be disposed in the air outlet 12.

The base 50 supports the motor 60 and the shaft 15. For example, the base 50 is fixed to the second casing 120 via the fixed blade 70. As viewed from the outside of the air outlet 12, the base 50 is formed so as to cover the motor 60 in the Z-axis direction. For example, the base 50 includes a control board for driving the motor 60.

Also, the fan 100 includes a bearing retainer that retains the bearings 16 and 17. The bearing retainer is, for example, formed in a cylindrical shape, and is supported by the base 50.

[Motor]

The motor 60 as illustrated in FIG. 2 and FIG. 4 is disposed, as described above, inside of the cylindrical portion 40. The motor 60 includes the rotator 61 and a stator 62. The stator 62 is disposed inside of the rotator 61 in the radial direction. The rotator 61 is disposed outside of the stator 62 in the radial direction.

The rotator 61 includes the magnet 61*a* that is disposed outside of the stator 62 in the radial direction. The magnet 61*a* is formed in, for example, a cylindrical shape. The stator 62 is disposed inside of the cylindrical portion 40. The stator 62 includes, for example, an iron core and a coil. The stator 62 is fixed to the casing 10. The stator 62 is fixed via the base 50 to the casing 10.

The rotator 61 rotates together with the impeller 20. The rotator 61 and the impeller 20 can rotate together with the shaft 15.

Also, as illustrated in FIG. 6, the rotor blade 30 and the fixed blade 70 are disposed outside in the radial direction of the magnet 61*a* of the rotator 61. In the Z-axis direction, at least part of a front-side (air inlet 11 side) portion of the magnet 61*a* is disposed so as to overlap the rotor blade 30. In other words, as viewed in the radial direction, the front-side portion of the magnet 61*a* is disposed so as to overlap the rotor blade 30. In the Z-axis direction, at least part of a back-side (air outlet 12 side) portion of the magnet 61*a* is disposed so as to overlap the fixed blade 70. In other words, as viewed in the radial direction, the back-side portion of the magnet 61*a* is disposed so as to overlap the fixed blade 70.

[Fixed Blade]

As illustrated in FIG. 2 and FIG. 6, a plurality of fixed blades 70 extend, in the radial direction, from the inner circumferential surface 121 of the casing 10 toward an outer circumferential surface 42*a* of the cylindrical portion 40. A length L70 in the Z-axis direction of the plurality of fixed blades 70 is longer than a width W70 along the radial direction of the plurality of fixed blades 5, 70.

The plurality of fixed blades 70 may be helically formed along a circumferential direction of the shaft 15. The fixed blade 70 may be formed, in the Z-axis direction, from a position downstream of the step 80 to the position of a back end of the casing 10. The position of the back end of the casing 10 may be the position of the air outlet 12. The length L70 in the Z-axis direction of the plurality of fixed blades 70 may be a length from the most upstream position of the fixed blade 70 to the position of the back end of the casing 10.

The width W70 along the radial direction of the fixed blade 70 may be different in the Z-axis direction. As described above, the fixed blade 70 connects the base 50 and the second casing 120 to each other in the radial direction. At the back end of the fixed blade 70, the fixed blade 70 connects an outer circumferential surface of the base 50 and the inner circumferential surface 121 of the second casing 120 to each other.

The width W70 of the fixed blade 70 along the radial direction may be a distance between an end portion 70*a* of the fixed blade 70 and the inner circumferential surface 121 of the second casing 120. The width W70 of the fixed blade 70 along the radial direction may be a distance between the outer circumferential surface of the base 50 and the inner circumferential surface 121 of the second casing 120. It is enough that the length L70 of the fixed blade 70 in the Z-axis direction is longer than the width W70 of the fixed blade 70 along the radial direction.

As illustrated in FIG. 6, the plurality of fixed blades 70 project, in the radial direction, from the inner circumferential surface 121 of the second casing 120 so as to become closer to the outer circumferential surface 42*a* of the portion 42 of the cylindrical portion 40. In the radial direction, the end portion 70*a* of the plurality of fixed blades 70 is disposed at a position inside of an outer circumferential surface 41*a* of the portion 41 and outside of the outer circumferential surface 42*a* of the portion 42. The end portion 70*a* of the fixed blade 70 is disposed, in the radial direction, away from the outer circumferential surface 42*a* of the portion 42. Also, the end portion 70*a* of the fixed blade 70 is disposed downstream of the step 80 in the Z-axis direction.

[Positional Relationship Between Camber Line and Blade Chord of the Rotor Blade]

Next, a positional relationship between a camber line 37 and a blade chord 38 of the rotor blade 30 will be described. The camber line 37 of the rotor blade 30 is disposed, in the Z-axis direction, at a position that is closer to the air outlet 12 than the blade chord 38 connecting a front edge 35 and a back edge 36 of the rotor blade 30. In other words, the camber line 37 is disposed downstream of the blade chord 38. The rotor blade 30 rotates about the Z axis. A rotation direction of the rotor blade 30 is from an upper portion to a lower portion in FIG. 7. In the rotor blade 30, one edge having a greater thickness is the front edge 35, and the other edge having a smaller thickness is the back edge 36.

The plurality of rotor blades 30 have a projecting shape with respect to a rotation direction of the impeller 20. The rotation direction of the impeller 20 may be a circumferential direction of the impeller 20. The projecting shape includes a thickening shape. For example, in a cross-sectional surface orthogonal to the shaft 15, the rotor blade 30 includes a shape thickening in the rotation direction of the impeller 20.

[Positional Relationship Between the Plurality of Rotor Blades and the Fixed Blade]

Next, a positional relationship between the plurality of rotor blades 30 and the fixed blade 70 will be described. As illustrated in FIG. 8, an outer circumferential edge 32 of the plurality of rotor blades 30 is disposed at a position that is closer to the air inlet 11 than a base end portion 33 of the rotor blade 30. In other words, the outer circumferential edge 32 of the rotor blade 30 is disposed upstream of the base end portion 33. The outer circumferential edge 32 may be an end portion, of the rotor blade 30, of the outer circumference in the radial direction. The base end portion 33 may be an end portion, of the rotor blade 30, of the inner circumference in the radial direction. The maximum outer diameter of the rotor blade 30 is an outer diameter at the outer circumferential edge 32. The outer circumferential edge 32 may be a position, of the outer circumference of the rotor blade 30, at the most downstream side in the Z-axis direction. The position at the most downstream side is a position that is the closest to the air outlet 12 in the Z-axis direction.

In the Z-axis direction, a distance L31 between the rotor blade 30 and the fixed blade 70 outside in the radial direction is longer than a distance L32 between the rotor blade 30 and the fixed blade 70 inward in the radial direction. The distance L31 is a distance, in the Z-axis direction, between the outer circumferential edge 32 of the rotor blade 30 and the fixed blade 70. The distance L32 is a distance, in the Z-axis direction, between the base end portion 33 of the rotor blade 30 and the fixed blade 70. The distance L31 at the outer diameter side is, for example, a length that is 12% or more and preferably 15% or more of the inner diameter ID12 of the air outlet 12. The distance L32 at the inner diameter may be, for example, a length that is 6% or more and preferably 8% or more of the inner diameter ID12 of the air outlet 12.

[Operation]

Next, the operation of the fan 100 will be described. In response to the motor 60 being driven, the rotator 61, the impeller 20, and the shaft 15 rotate together. In response to the rotation of the impeller 20, the plurality of rotor blades 30 rotate. In response to the rotation of the plurality of rotor blades 30, air flows into the flow path 130 from the air inlet 11. The air inside of the flow path 130 flows from the air inlet 11 toward the air outlet 12.

The air from the air inlet 11 flows in the flow path 131 between the outer circumferential surface 22 of the hub portion 21 and the inner circumferential surface 111 of the increasing diameter portion 115. The width of the increasing diameter portion 115 along the radial direction of the flow path 131 becomes narrower toward downstream.

The air flowing through the flow path 131 between the hub portion 21 and the increasing diameter portion 115 flows through the flow path 131 between the outer circumferential surface 41*a* of the portion 41 of the cylindrical portion 40 and the inner circumferential surface 111 of the first casing 110.

The air flowing through the flow path 131 of the first casing 110 flows through the flow path 132 of the second casing 120. The air flowing into the flow path 132 passes through the position corresponding to the step 80, and flows through the flow path 132 between the outer circumferential surface 42*a* of the portion 42 of the cylindrical portion 40 and the inner circumferential surface 121 of the second casing 120.

The flow path 132 is provided with the fixed blade 70. The air flowing into the flow path 132 is rectified by the fixed blade 70. Swirling of the flow of the air is reduced, and the flow along the Z-axis direction is promoted. The air rectified inside of the flow path 132 is discharged to the outside from the air outlet 12. The air discharged from the air outlet 12 is fed, for example, into the casing of an electronic device. The air fed into the casing cools the interior of the electronic device.

[Actions and Effects]

The fan 100 according to the first embodiment includes: the casing 10 that includes the air inlet 11 and the air outlet 12, and in which the flow path 130 communicating from the air inlet 11 to the air outlet 12 is formed; the impeller 20 that is disposed in the casing 10 and rotatable about an axis, the impeller including the hub portion 21 disposed at the air inlet 11 side, the rotor blade 30 formed on the hub portion 21, and the cylindrical portion 40 that extends from the hub portion 21 to the air outlet 12 side, and forms the flow path 130 between the cylindrical portion 40 and the casing 10; and the plurality of fixed blades 70 that extend, in the radial direction, from the inner circumferential surface 121 of the casing 10 toward the outer circumferential surface 42*a* of the cylindrical portion 40.

The casing 10 includes the increasing diameter portion 115 having the inner circumferential surface 111 that increases in the inner diameter from the air inlet 11 side toward the air outlet 12 side.

The maximum outer diameter OD30 of the plurality of rotor blades 30 is larger than the minimum inner diameter ID13 of the increasing diameter portion 115. The position P1 of the minimum inner diameter ID13 of the increasing diameter portion 115 is, in the Z-axis direction, closer to the air inlet 11 side than the position of the maximum outer diameter OD30 of the impeller 20.

The plurality of rotor blades 30 project, in the Z-axis direction, from the hub portion 21 toward the air inlet 11. The length L70 in the Z-axis direction of the plurality of fixed blades 70 is longer than the width W70 along the radial direction of the plurality of fixed blades 70.

According to the fan 100 as described above, it is possible to ensure airflow volume and suppress an increase in noise. In the fan 100, the width of the flow path 131 becomes narrower toward downstream in the vicinity of the air inlet 11, and thus it is possible to ensure a static pressure. In the fan 100, it is possible to sufficiently ensure the length L70 of the fixed blade 70 in the Z-axis direction, and thus swirling of the flow of the air is reduced. Thereby, the air is readily discharged from the air outlet 12, and it is possible to ensure airflow volume while reducing the number of rotations of the impeller 20. In the fan 100, it is possible to reduce the number of rotations of the impeller 20, the motor 60, and the shaft 15, and thus suppress an increase in noise.

Also, in the fan 100, the cylindrical portion 40 includes the portion 41 (first portion) and the portion 42 (second portion) that are connected to each other in the Z-axis direction. The portion 41 is disposed, in the Z-axis direction, to be closer to the plurality of rotor blades 30, and the portion 42 is disposed, in the Z-axis direction, to be farther from the plurality of rotor blades 30. The outer diameter OD42 of the portion 42 is smaller than the outer diameter OD41 of the portion 41. The 5 plurality of fixed blades 70 project, in the radial direction, from the inner circumferential surface 121 of the second casing 120 so as to become closer to the outer circumferential surface 42*a* of the portion 42. In the radial direction, the end portion 70*a* of the plurality of fixed blades 70 is disposed at a position inside of the outer circumferential surface 41*a* of the portion 41 and outside of the outer circumferential surface 42*a* of the portion 42.

According to the fan 100 as described above, the fixed blade 70 is formed, in the radial direction, inside of the outer circumferential surface 41*a* of the portion 41. Thereby, the fixed blade 70 is formed correspondingly to the whole width of the flow path 131 in the radial direction. Therefore, owing to the fixed blade 70, it is possible to reliably reduce the swirling of the flow of the air. The fan 100 is improved in air discharge performance.

Also, in the fan 100, the outer circumferential surface of the cylindrical portion 40 is provided with the step 80, and the portion 41 is disposed, in the Z-axis direction, to be closer to the plurality of rotor blades 30 than the step 80, and the portion 42 is disposed, in the Z-axis direction, to be farther from the plurality of rotor blades 30 than the step 80. The portion 41 is disposed, in the Z-axis direction, at the air inlet 11 side of the step 80. The portion 42 is disposed, in the Z-axis direction, at the air outlet 12 side of the step 80. In the fan 100, the portion 41 of the cylindrical portion 40 is disposed upstream of the step 80, and the portion 42 of the cylindrical portion 40 is disposed downstream of the step 80. In the fan 100, the fixed blade 70 is formed so as to become closer to the outer circumferential surface 42*a* of the portion 42.

Also, the fan 100 includes the stator 62 disposed inward in the radial direction, and the rotator 61 including the magnet 61*a* disposed outside of the stator 62 in the radial direction. The rotator 61, the cylindrical portion 40, and the impeller 20 are rotatable together. The fan 100 is an outer rotor type fan in which the rotator 61 is disposed outside of the stator 62 in the radial direction.

Also, in the fan 100, the camber line 37 of the rotor blade 30 is disposed, in the Z-axis direction, at a position that is closer to the air outlet 12 than the blade chord 38 connecting the front edge 35 and the back edge 36 of the rotor blade 30. The rotor blade 30 of the fan 100 may be of a negative camber. When the rotor blade 30 is of a negative camber, it is possible to increase the static pressure and hence the airflow volume, thereby improving efficiency of the fan. The plurality of rotor blades 30 each have a projecting shape with respect to the rotation direction of the impeller 20. According to the fan 100 including the rotor blade 30, it is possible to increase the static pressure and hence the airflow volume, thereby improving efficiency of the fan.

Also, in the fan 100, the outer circumferential edge 32 of the plurality of rotor blades 30 is disposed at a position that is closer to the air inlet 11 than the base end portion 33 that is a position inward in the radial direction. In the Z-axis direction, the distance L31 between the plurality of rotor blades 30 and the fixed blade 70 outside in the radial direction is longer than the distance L32 between the plurality of rotor blades 30 and the fixed blade 70 inward in the radial direction. Thereby, it is possible to suppress reduction in the airflow volume at a high static pressure, and reduce noise. The fan 100 can ensure airflow volume at a high static pressure.

Also, in the fan 100, in the Z-axis direction, the distance between the lowermost end of the outer circumferential edge 32 of the plurality of rotor blades 30 and an upper end 70*b* of the fixed blade 70 is longer than the distance L32 between the lowermost end of an inner circumferential edge of the plurality of rotor blades 30 and the upper end 70*b* of the fixed blade 70. The lowermost end of the outer circumferential edge 32 of the rotor blade 30 may be a position that is the closest to the fixed blade 70 in the Z-axis direction. The upper end 70*b* of the fixed blade 70 may be a position that is the closest to the rotor blade 30 in the Z-axis direction. The lowermost end of the inner circumferential edge of the rotor blade 30 may be a position that is the closest to the fixed blade 70 in the Z-axis direction.

Also, in the fan 100, the outer diameter OD12 of the outer circumferential surface 22 at the back end 21*b*, which is a farther end of the hub portion 21 from the air inlet 11, is larger than the outer diameter OD11 of the outer circumferential surface 22 at the end portion 21*a*, which is a closer end thereof to the air inlet 11. Owing to the hub portion 21, the width of the flow path 131 at the upstream side can become narrower toward downstream. Thereby, it is possible to increase the static pressure.

Also, in the fan 100, in the cross-sectional surface along the Z-axis direction, the tilt angle θ1 of the outer circumferential surface 22 of the hub portion 21 with respect to the shaft 15 is greater than the tilt angle θ2 of the inner circumferential surface 111 of the increasing diameter portion 115 of the first casing 110 with respect to the shaft 15. Thereby, the width of the flow path 131 can be narrowed so as to become closer from the inner diameter side to the outer diameter side.

Also, in the fan 100, the casing 10 is provided with the air inlet 11, and includes: the first casing 110 housing the impeller 20; and the second casing 120 that is provided with the air outlet 12 and in which the fixed blade 70 is formed on the inner circumferential surface 121. In the fan 100, the casing 10 can be formed by connecting the first casing 110 and the second casing 120 to each other. After the impeller 20, the motor 60, and the shaft 15 are disposed at predetermined positions, the first casing 110 and the second casing 120 can be connected to each other. The first casing 110 and the second casing 120 include a locking type engagement portion, and are connected to each other in the Z-axis direction. The locking type engagement portion includes, for example, an engagement claw and a recessed portion with which the engagement claw is to be engaged.

In the above, preferable embodiments of the present invention have been described in detail. However, the present invention is not limited to the above-described embodiments. Various modifications, substitutions, and the like can be applied in the above-described embodiments without departing from the scope of the present invention. Also, the features that have been separately described can be combined together unless there occurs any technical contradiction.

The above-described fan 100 includes the first casing 110 and the second casing 120 that are divided in the Z-axis direction. However, the casing 10 is not limited to one including the first casing 110 and the second casing 120. For example, the fan 100 may include casings that are divided into two or more in the radial direction or circumferential direction. Also, no limitation is imposed on the shape of the casing 10, which may be formed in a cuboid or a cylindrical body.

Also, the step 80 may not be formed on the outer circumferential surface of the cylindrical portion 40. A recessed portion or a diameter-reduced portion may be formed on the outer circumferential surface of the cylindrical portion 40. According to such a configuration, the end portion 70*a* of the fixed blade 70 can be disposed, in the radial direction, inside of the maximum outer diameter portion of the cylindrical portion 40.

In the above-described embodiments, the fan 100 including the outer rotor type motor 60 is exemplified. However, the motor 60 to be included may be an inner rotor type motor in which a rotator is disposed inward in the radial direction and a stator is disposed outside in the radial direction.

In the above-described embodiments, the fixed blade 70 is of a negative camber. However, the fixed blade 70 may be of a positive camber.

[Object According to Related Art]

A performance required for fans is airflow volume. The airflow volume can be increased by increasing the rotation speed of an impeller. However, there is a risk of an increase in noise.

It is an object of the present disclosure to provide a fan that can ensure airflow volume and suppress an increase in noise.

First Modified Example

Figure 9:
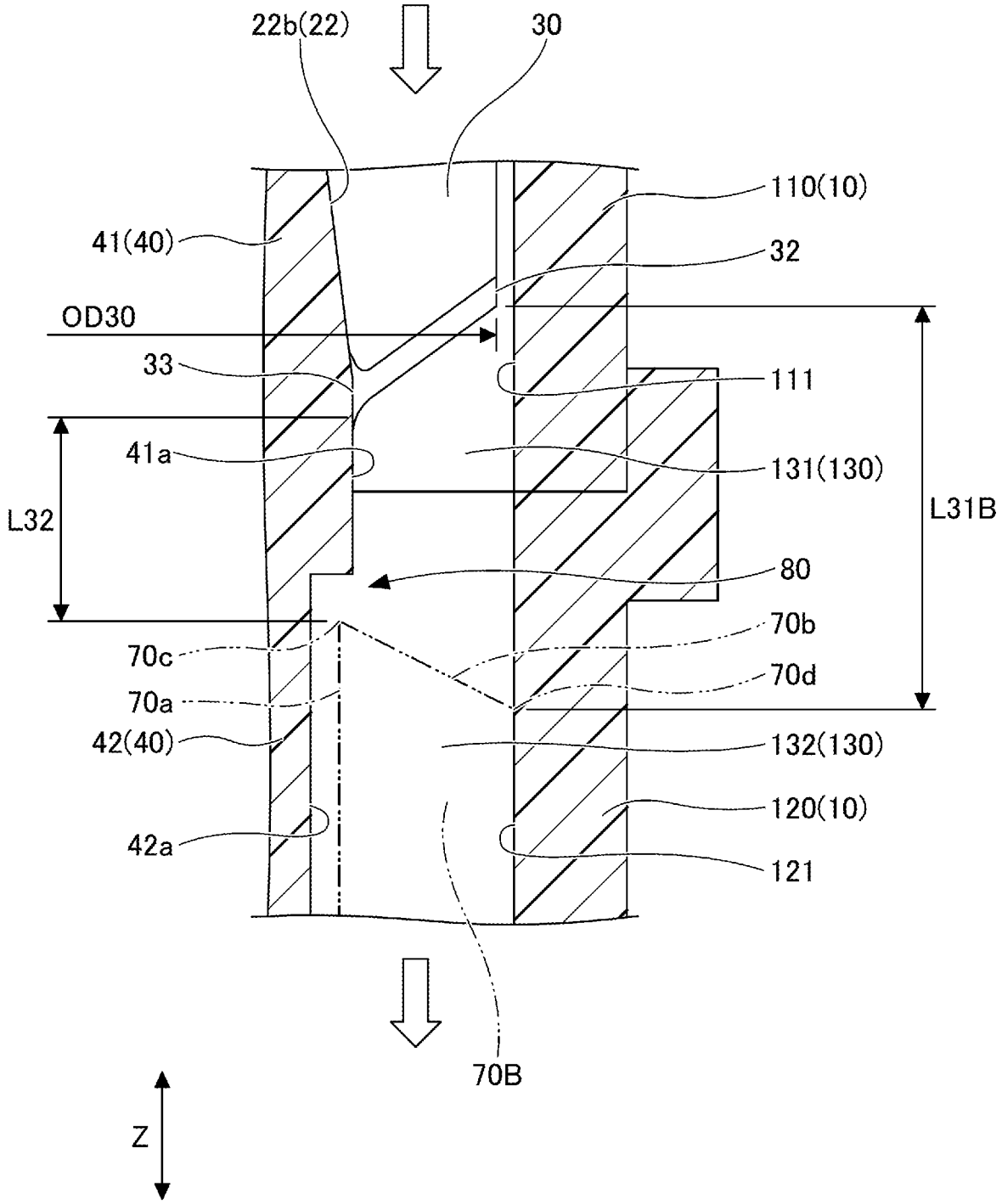
FIG. 9 is a view illustrating a positional relationship in a Z-axis direction of the rotor blade and the fixed blade of a fan according to a first modified example.

Next, the fan 100 according to the first modified example will be described. FIG. 9 is a view illustrating a positional relationship in the Z-axis direction of the rotor blade 30 and a fixed blade 70B of the fan according 5 to the first modified example. The fan 100 according to the first modified example includes the fixed blade 70B instead of the fixed blade 70.

As illustrated in FIG. 9, the upper end 70*b* in the Z-axis direction of the fixed blade 70B may not be orthogonal to the Z axis. The upper end 70*b* may tilt with respect to the Z axis. An end portion 70*c* inside of the upper end 70*b* in the radial direction is located at the air inlet 11 side of an end portion 70*d* outside of the upper end 70*b* in the radial direction. In other words, the end portion 70*d* outside of the upper end 70*b* in the radial direction is located at the air outlet 12 side of the end portion 70*c* inside of the upper end 70*b* in the radial direction.

In the Z-axis direction, a distance L31B between the rotor blade 30 and the fixed blade 70B outside in the radial direction is longer than a distance L32 between the rotor blade 30 and the fixed blade 70B inward in the radial direction. The distance L31B is a distance, in the Z-axis direction, between the outer circumferential edge 32 of the rotor blade 30 and the end portion 70*d* of the fixed blade 70B. The distance L32 is a distance, in the Z-axis direction, between the base end portion 33 of the rotor blade 30 and the end portion 70*c* of the fixed blade 70.

Second Modified Example

Figure 10:
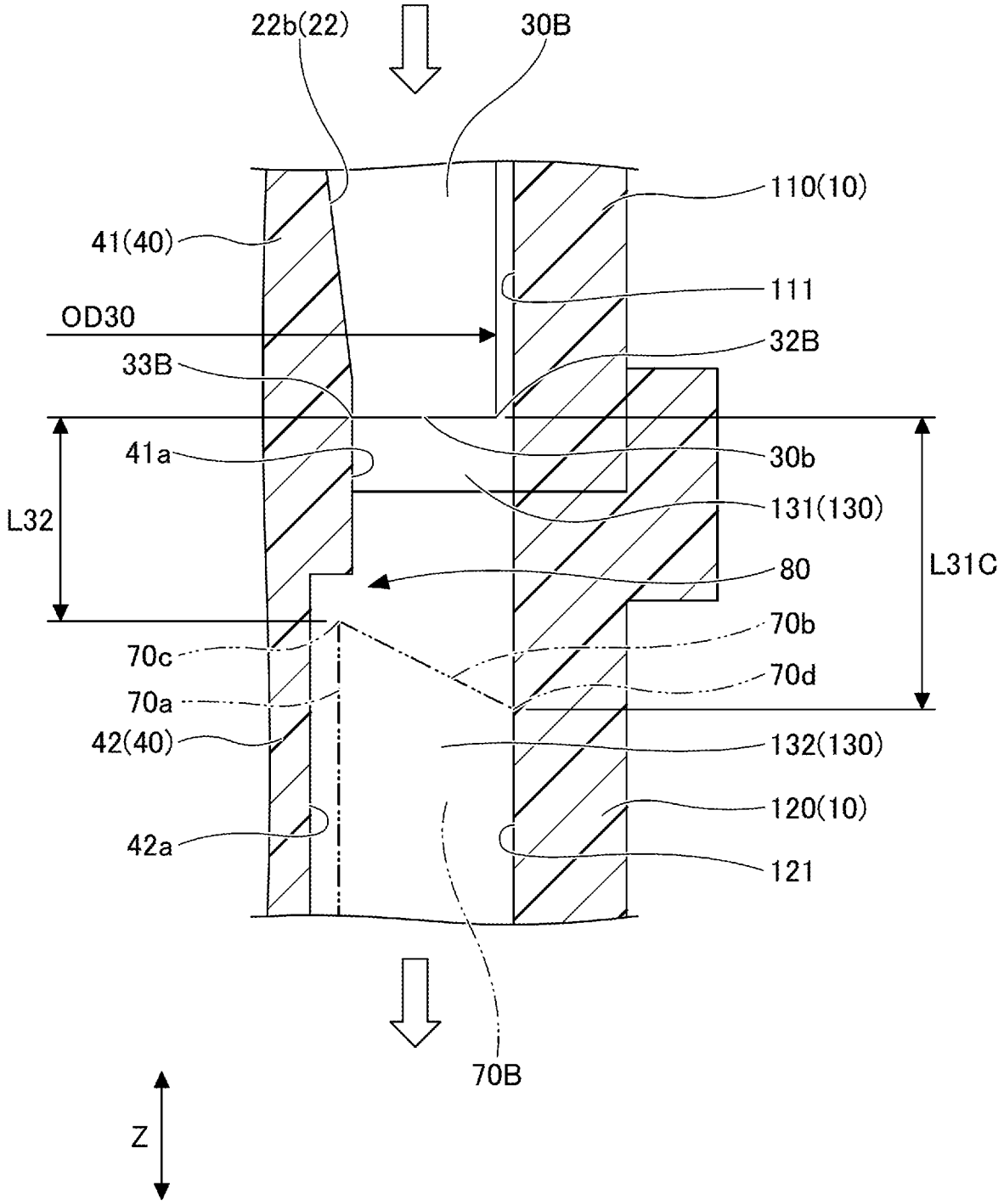
FIG. 10 is a view illustrating a positional relationship in the Z-axis direction of the rotor blade and the fixed blade of a fan according to a second modified example.

Next, the fan 100 according to the second modified example will be described. FIG. 10 is a view illustrating a positional relationship in the Z-axis direction of a rotor blade 30B and the fixed blade 70B of the fan 100 according to the second modified example. The fan 100 according to the second modified example includes the rotor blade 30B instead of the rotor blade 30. The fan 100 according to the second modified example includes the fixed blade 70B similar to the fan 100 according to the first modified example.

As illustrated in FIG. 10, the lowermost end 30*b* in the Z-axis direction of the rotor blade 30B may be orthogonal to the Z-axis direction. The base end portion 33B at the lowermost end 30*b* and the outer circumferential edge 32B at the lowermost end 30*b* may be disposed at the same position in the Z-axis direction.

In the Z-axis direction, a distance L31C between the rotor blade 30B and the fixed blade 70B outside in the radial direction is longer than the distance L32 between the rotor blade 30B and the fixed blade 70B inward in the radial direction. The distance L31C is a distance, in the Z-axis direction, between the outer circumferential edge 32B of the rotor blade 30B and the end portion 70*d* of the fixed blade 70B. The distance L32 is a distance, in the Z-axis direction, between the base end portion 33B of the rotor blade 30B and the end portion 70*c* of the fixed blade 70B.

REFERENCE SIGNS LIST

100 . . . fan, 10 . . . casing, 11 . . . air inlet, 12 . . . air outlet, 15 . . . shaft, 20 . . . impeller, 21 . . . hub portion, 22 . . . outer circumferential surface, 22*a* . . . first tilt surface, 22*b* . . . second tilt surface, 30, 30B . . . rotor blade, 30*b* . . . lowermost end, 35 . . . front edge, 36 . . . back edge, 37 . . . camber line, 38 . . . blade chord, 40 . . . cylindrical portion, 41 . . . portion (first portion), 41*a* . . . outer circumferential surface (outer circumferential surface of the first portion), 42 . . . portion (second portion), 42*a* . . . outer circumferential surface (outer circumferential surface of the second portion), 60 . . . motor, 61 . . . rotator, 62 . . . stator, 70, 70B . . . fixed blade, 70*a* . . . end portion, 70*b* . . . upper end, 80 . . . step, 115 . . . increasing diameter portion, 110 . . . first casing, 120 . . . second casing, 130 . . . flow path, ID13 . . . minimum inner diameter of increasing diameter portion, L31, L31B, L31C . . . distance (distance between the rotor blade and the fixed blade), L32 . . . distance (distance between the rotor blade and the fixed blade), L70 . . . length in axial direction of the fixed blade, OD11 . . . outer diameter (outer diameter of the hub portion), OD12 . . . outer diameter (outer diameter of the hub portion), OD30 . . . maximum outer diameter of the rotor blade, OD41 . . . outer diameter (outer diameter of the first portion of the cylindrical portion), OD42 . . . outer diameter (outer diameter of the second portion of the cylindrical portion), W70 . . . width along the radial direction of the fixed blade, θ1 . . . tilt angle (tilt angle of the outer circumferential surface of the hub portion, tilt angle of the first tilt surface), θ2 . . . tilt angle (tilt angle of the inner circumferential surface of the casing), θ3 . . . tilt angle (tilt angle of the second tilt surface), X . . . X-axis direction (radial direction), Y . . . Y-axis direction (radial direction), Z . . . Z-axis direction (axial direction).

The invention claimed is:

1. A fan comprising:

a casing that includes an air inlet and an air outlet, and in which a flow path communicating from the air inlet to the air outlet is formed;

an impeller that is disposed in the casing and rotatable about an axis, the impeller including a hub portion disposed at an air inlet side, a plurality of rotor blades formed on the hub portion, each of the plurality of rotor blades including a leading edge and a trailing edge, and a cylindrical portion that extends from the hub portion to an air outlet side, and forms a flow path between the cylindrical portion and the casing; and a plurality of fixed blades that extend, in a radial direction, from an inner circumferential surface of the casing toward an outer circumferential surface of the cylindrical portion of the impeller, wherein the casing includes an increasing diameter portion having an inner circumferential surface that increases in inner diameter from the air inlet side toward the air outlet side, a maximum outer diameter of the plurality of rotor blades is larger than a minimum inner diameter of the increasing diameter portion, a position of the minimum inner diameter of the increasing diameter portion is located, in an axial direction, at the air inlet side of a position of the maximum outer diameter of the plurality of rotor blades, the plurality of rotor blades project, in the axial direction, beyond the hub portion toward the air inlet, a length of the plurality of fixed blades in the axial direction is longer than a width of the plurality of fixed blades along the radial direction, and a camber line of each rotor blade of the plurality of rotor blades is located closer to the air outlet than a blade chord that is defined as a linear distance between the leading edge and the trailing edge of the rotor blade.

2. The fan according to claim 1, wherein the cylindrical portion includes a first portion and a second portion that are connected to each other in the axial direction, the first portion is disposed at the air inlet side in the axial direction, the second portion is disposed at the air outlet side of the first portion in the axial direction, an outer diameter of the second portion is smaller than an outer diameter of the first portion, the plurality of fixed blades project, in the radial direction, from the inner circumferential surface of the casing so as to become closer to an outer circumferential surface of the second portion, and in the radial direction, an end portion of the plurality of fixed blades is disposed at a position inside of an outer circumferential surface of the first portion and outside of the outer circumferential surface of the second portion.

3. The fan according to claim 2, wherein a step is formed in the outer circumferential surface of the cylindrical portion, the first portion is disposed at the air inlet side of the step in the axial direction, and the second portion is disposed at the air outlet side of the step in the axial direction.

4. The fan according to claim 1, further comprising:

a stator disposed inside in the radial direction; and a rotator including a magnet disposed outside of the stator in the radial direction, wherein the rotator and the impeller are rotatable together.

5. The fan according to claim 1, wherein the plurality of rotor blades have a projecting shape with respect to a rotation direction of the impeller.

6. The fan according to claim 1, wherein in the axial direction, a distance between a lowermost end of an outer circumferential edge of the plurality of rotor blades and an upper end of the fixed blade is longer than a distance between a lowermost end of an inner circumferential edge of the plurality of rotor blades and the upper end of the fixed blade.

7. The fan according to claim 1, wherein an outer diameter of an outer circumferential surface of the hub portion that is closer to the air outlet is larger than the outer diameter of the outer circumferential surface thereof that is closer to the air inlet.

8. The fan according to claim 7, wherein in a cross-sectional surface along the axial direction, a tilt angle of the outer circumferential surface of the hub portion with respect to the axial direction is greater than a tilt angle of the inner circumferential surface of the casing with respect to the axial direction.

9. The fan according to claim 1, wherein the casing includes a first casing housing the impeller, and a second casing in which the fixed blade is formed on an inner circumferential surface thereof.

10. The fan according to claim 1, wherein an outer circumferential surface of the hub portion includes a first tilt surface and a second tilt surface that tilt with respect to the axis at angles different from each other in a cross-sectional surface along the axial direction.

11. The fan according to claim 10, wherein the fan includes a stator disposed inside in the radial direction, and a rotator including a magnet disposed outside of the stator in the radial direction, and the second tilt surface is disposed at a position that overlaps the magnet in the axial direction.

12. The fan according to claim 10, wherein the second tilt surface is disposed at the air outlet side of the first tilt surface in the axial direction, and a tilt angle of the second tilt surface with respect to the axis is smaller than a tilt angle of the first tilt surface with respect to the axis.

13. The fan according to claim 4, wherein in the axial direction, at least part of a portion, at the air inlet side, of the magnet is disposed so as to overlap the rotor blade, and at least part of a portion, at the air outlet side, of the magnet is disposed so as to overlap the fixed blade.

14. The fan according to claim 1, further comprising:

a stator disposed inside in the radial direction; and a rotator including a magnet disposed outside of the stator in the radial direction.

15. The fan according to claim 1, wherein the hub portion has an outer circumferential surface, and in a cross-sectional surface along the axial direction, a tilt angle of the outer circumferential surface of the hub portion with respect to the axial direction is greater than a tilt angle of the inner circumferential surface of the casing with respect to the axial direction.

16. The fan according to claim 1, wherein the cylindrical portion includes a plurality of portions having different outer diameters that decrease stepwise toward the air outlet, an air outlet port-side portion, among the plurality of portions of the cylindrical portion, has an outer circumferential surface, the plurality of fixed blades are provided in a flow path between the outer circumferential surface of the air outlet-side portion and the inner circumferential surface of the casing.

17. The fan according to claim 16, wherein the plurality of portions of the cylindrical portion include a first portion and a second portion that are connected to each other in the axial direction, the second portion being the air outlet-side portion, the first portion is disposed at the air inlet side in the axial direction, the second portion is disposed at the air outlet side of the first portion in the axial direction, an outer diameter of the second portion is smaller than an outer diameter of the first portion, the plurality of fixed blades project, in the radial direction, from the inner circumferential surface of the casing so as to become closer to the outer circumferential surface of the second portion, and in the radial direction, an end portion of the plurality of fixed blades is disposed at a position inside of an outer circumferential surface of the first portion and outside of the outer circumferential surface of the second portion.

* * * * *